US007203980B2

(12) United States Patent
McBrayer, Jr. et al.

(10) Patent No.: US 7,203,980 B2
(45) Date of Patent: Apr. 17, 2007

(54) COLLAPSIBLE MOUNTING FRAME FOR SUPPORTING A RAISED PLATFORM

(75) Inventors: John H. McBrayer, Jr., New Braunfels, TX (US); Clay J. Skarovsky, New Braunfels, TX (US)

(73) Assignee: KLN Steel Products Ltd., San Antonio, TX (US)

( * ) Notice: Subject to any disclaimer, the term of this patent is extended or adjusted under 35 U.S.C. 154(b) by 0 days.

(21) Appl. No.: 10/970,079

(22) Filed: Oct. 21, 2004

(65) Prior Publication Data

US 2006/0085909 A1 Apr. 27, 2006

(51) Int. Cl.
*A47C 19/20* (2006.01)

(52) U.S. Cl. ..... 5/2.1; 5/8; 5/9.1

(58) Field of Classification Search ..... 5/1, 5/2.1, 8, 9.1, 11
See application file for complete search history.

(56) References Cited

U.S. PATENT DOCUMENTS

| | | | | |
|---|---|---|---|---|
| 2,255,791 | A * | 9/1941 | Klopfer et al. | 5/93.1 |
| 2,536,357 | A * | 1/1951 | David | 5/99.1 |
| 5,233,707 | A * | 8/1993 | Perkins | 5/8 |
| 5,572,751 | A * | 11/1996 | Brandt | 5/9.1 |
| 6,292,959 | B1 * | 9/2001 | Rosenquist | 5/9.1 |
| 6,550,424 | B1 * | 4/2003 | Gao | 119/474 |

* cited by examiner

*Primary Examiner*—Patricia Engle
*Assistant Examiner*—Fredrick Conley
(74) *Attorney, Agent, or Firm*—Jackson Walker, LLP

(57) ABSTRACT

A collapsible mounting frame for a raised platform or a raised bed as a unitary construction with two end frame assemblies and a plurality of hinged horizontal support links. The mounting frame may be moved from a collapsed or folded position to an open, extended, operable position to support the overhead platform or bed. The space beneath the raised platform or bed may be more effectively utilized.

5 Claims, 5 Drawing Sheets

COLLAPSIBLE MOUNTING FRAME FOR SUPPORTING A RAISED PLATFORM

BACKGROUND OF THE INVENTION

The present invention relates to a mounting frame for supporting a raised platform. More particularly, the present invention relates to a foldable or collapsible frame to support an overhead bed to form what is known in the art as a loft bed.

As the cost per square foot of living space continues to escalate, it becomes important to be able to accommodate furniture in less space. One way to achieve this goal is to elevate a piece of furniture above floor level to make more effective use of the available volume of space above the floor. A loft bed is such a space saving device.

In apartments, dormitories, barracks, correctional facilities and other places having limited floor space, it is possible to raise the sleeping platform above the average height of the occupant. This allows the floor space below to be used to place a seating arrangement, desk, or other piece of furniture without interfering with the sleeping space.

While the present invention focuses on loft bed arrangements, it should be understood that the mounting frame of the present invention may support any raised platform which frees up floor space. The present collapsible frame employs very few separate parts, requires very little assembly time, provides a rigid, stable support for the raised platform, and is foldable into a tight, compact configuration to save space during storage. Because few separate parts are required with the present invention, there is less likelihood of parts being lost in transit or storage. When the frame subsequently is assembled there is less likelihood that will be an improper assembly thereby creating a possible safety hazard.

Presently existing "loft bed arrangements," generally have at least three separated sections or elements: two separate end frames and one (or more) separate horizontal support bars. The present invention is a single unit frame assembly. The assembly has two end frames pivotally connected to hinged horizontal stabilizers which fold and unfold from a stored (collapsed) position to operable (extended) position. No tools or implements are required to place the present mounting frame into service.

Each fame is provided with resilient bumpers to ensure a condensed, folded arrangement may be achieved without overflexing the stabilizer hinges. A strap may be affixed to the stabilizer linkage to allow the user to secure the assembly in the folded or collapsed position during transit and during storage.

DETAILED DESCRIPTION OF THE PREFERRED EMBODIMENT

Figure 1:
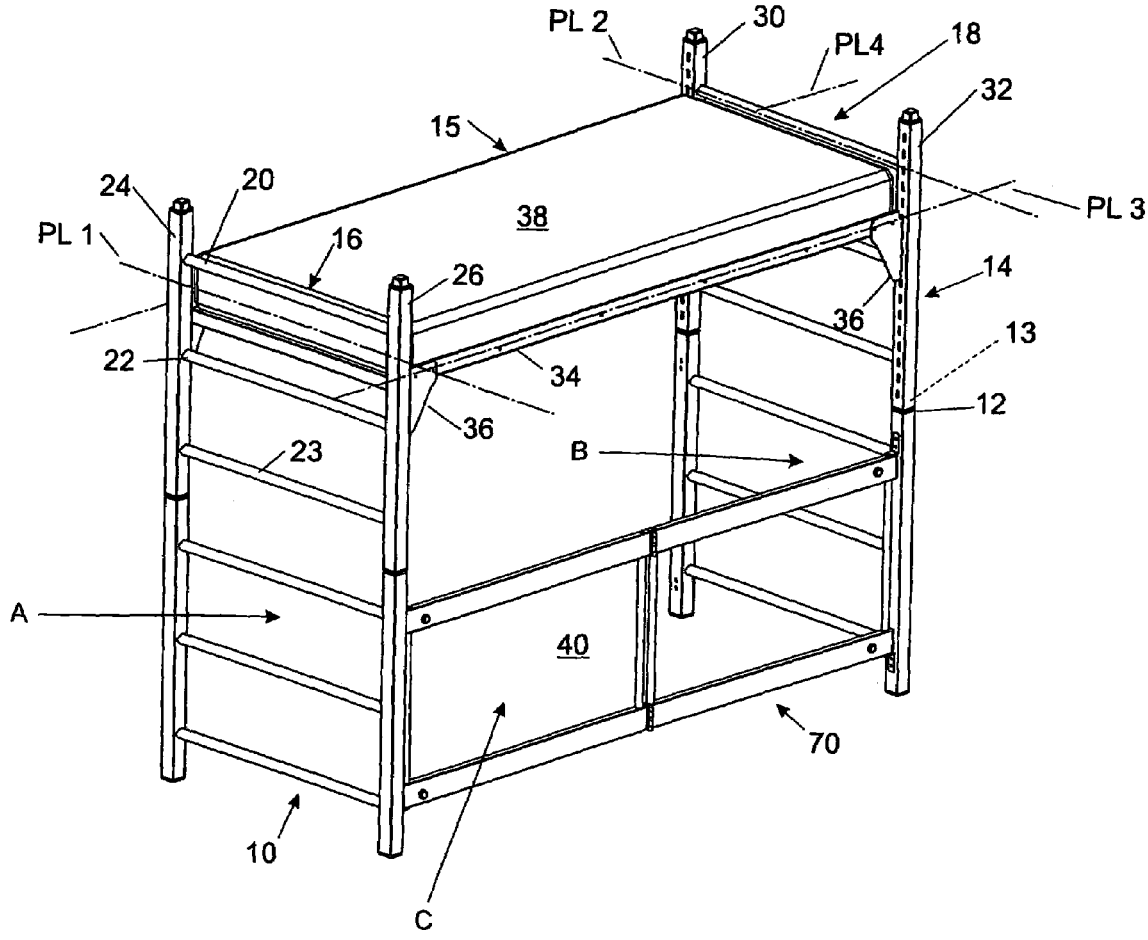
FIG. 1 is a top perspective view of the extended frame of the present invention mounted to the underside of a raised platform bed in the operable position.

FIG. 1 is a top perspective view of the extended frame of the present invention (10) mounted to the underside (12) of a raised platform (14). The raised platform (14) in FIG. 1 is a bed (15) having two end frame assemblies (16 and 18), each having a longitudinal axis (PL1 and PL2). A plurality of bed post support members (20, 22, and 23) extend between vertical bed posts (24 and 26) of end frame assembly (16). Similarly, a plurality of bed post support members extended between the vertical bed posts (30 and 32) of the second bed end frame (18). These bed end frame assemblies are held in a rigid spaced apart, parallel orientation by bed side support rails (34) extending along opposite sides of the bed and mounted by standard hardware or brackets (36) to the end frame assemblies (16 and 18). These rails have longitudinal axes (PL3 and PL4). A mattress (38) is supported between the end frames (16 and 18) and the support rails in a well known manner.

The collapsible mounting frame of the present invention (10) is attached to the underside (12) of the raised platform (14) in openings (13) in the bottom of the bed posts (24, 26, 30, and 32). As may be seen in FIG. 1, the frame (10) supports the bed (15) above the floor space (40) leaving an area beneath the bed for the placement of furniture or the like. As may be seen in FIG. 1, user access to the volume of space beneath bed is obtained through an access opening in the frame (10) formed by the three-sides (A, B, and C) of the frame (10).

Figure 2:
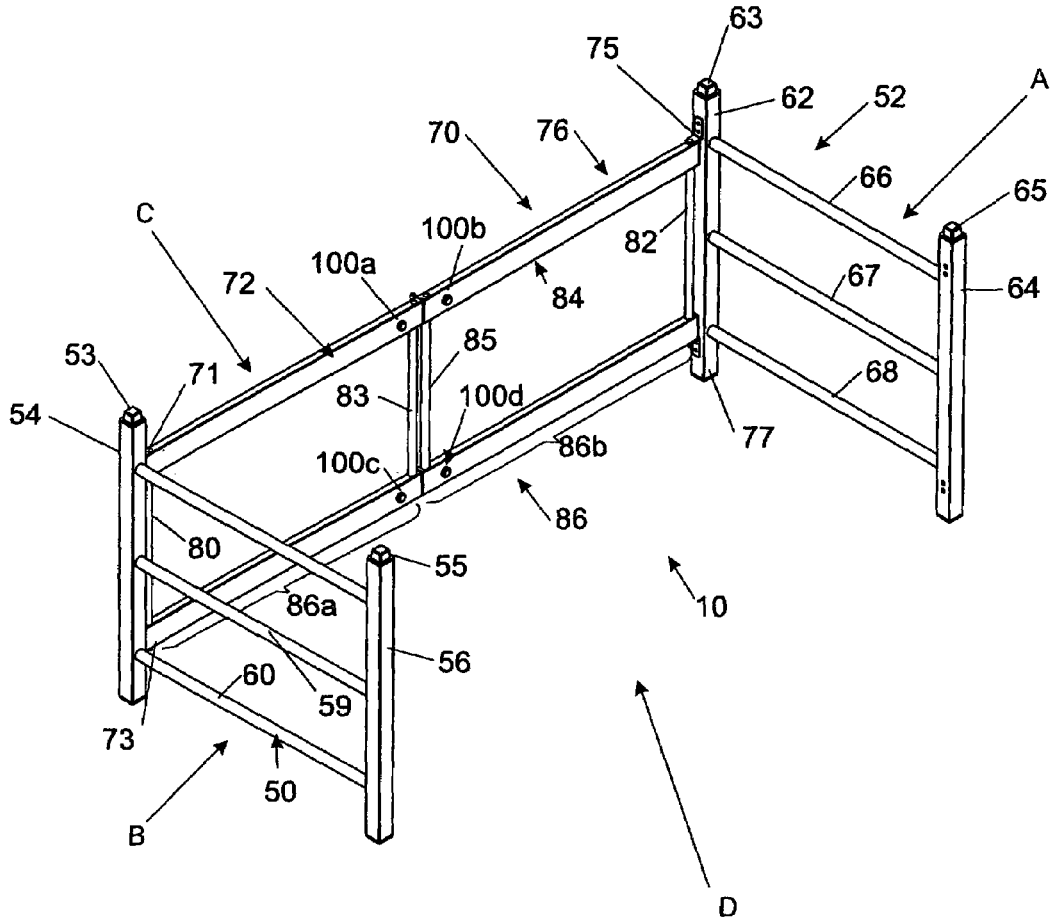
FIG. 2 shows an inside perspective view of the extended frame of the present invention without a supported platform.

Frame (10) as seen in FIG. 2 has end frame assemblies (50 and 52). Assembly (50) has two vertical end posts (54 and 56) each with an end post adaptor cap (53 and 55). Posts (54 and 56) are retained in parallel and coplanar relationship by a plurality of horizontal support members (58, 59, 60).

In a like manner end frame assembly (52) has two vertical posts (62 and 64) with end post adaptor caps (63 and 65). Posts (62 and 64) are retained in parallel and coplanar relationship by a plurality of horizontal support members (66, 67, 68).

Connecting the two end frames (50 and 52) is a horizontal frame stabilizer (70). As seen in FIG. 2, the bed frames (50 and 52) and the stabilizer (70) form a three-sided frame (10) with an access opening (D). The stabilizer (70) is pivotally connected at a first end (72) to vertical end post (54) by two pivot members (71 and 73), described in detail below. A second end (76) of the stabilizer (70) is pivotally connected to vertical end post (62) by two pivot members (75 and 77), again to be described in detail below.

The stabilizer (70) has a first vertical leg member (80) and a second vertical leg member (82) spaced apart from each other, as seen in FIG. 2. Leg members (80 and 82) are connected to horizontal support links (84 and 86). Optionally, additional vertical leg members (83 and 85) may be used to connect links (84 and 86) and provide additional structural support. Each link (84 and 86) has two link segments. Link (84) has segments (84*a* and 84*b*) while link (86) has segment (86*a* and 86*b*). (See FIGS. 4 and 5).

Links (84 and 86) are equal in length with each having a hinge (90 and 92) respectively at a midpoint along this length. Each link segment (84*a*, 84*b*, 86*a* and 86*b*) is of equal length. The hinges (90 and 92) allow the stabilizer (70) to move from a collapsed position (FIG. 3) to an extended position (FIGS. 2 and 5) as desired.

Figure 3:
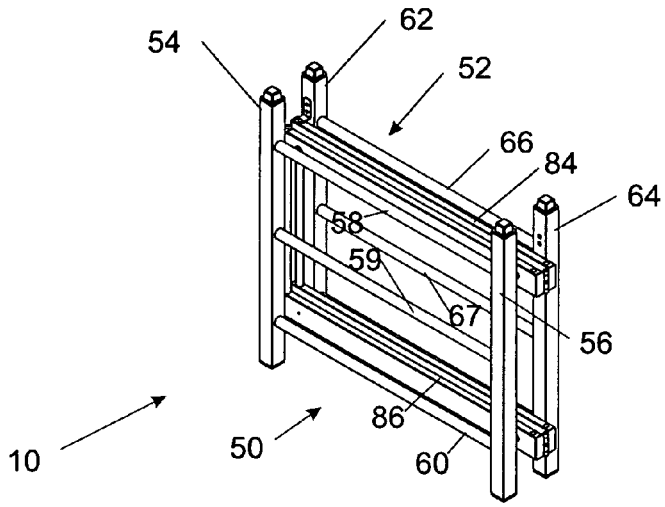
FIG. 3 illustrates in a perspective view the frame of the present invention in the collapsed, folded, or storage position.
Figure 4:
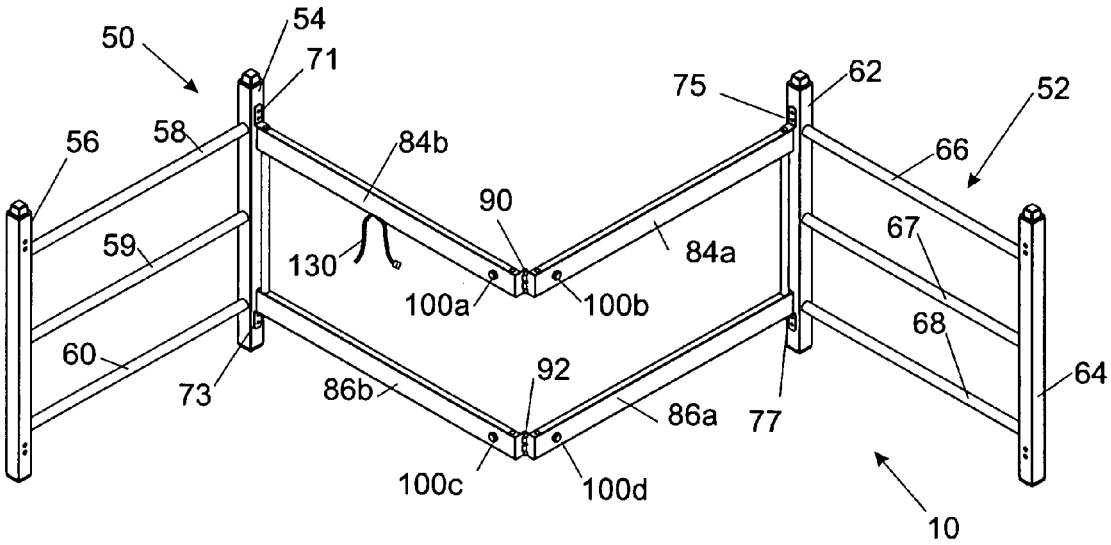
FIG. 4 shows a perspective view of the frame of the present invention in a transition position between the collapsed and extended positions.
Figure 5:
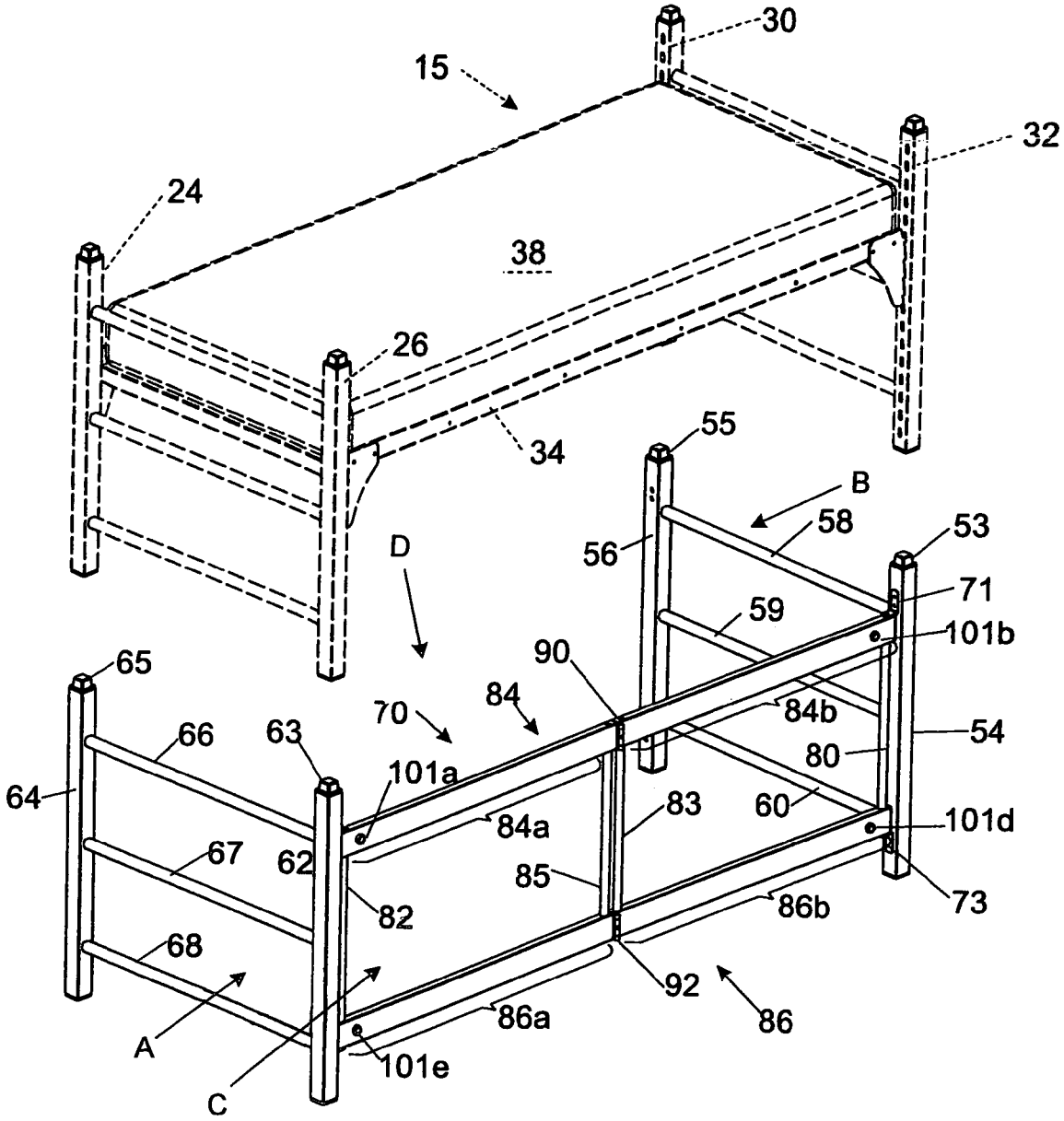
FIG. 5 illustrates an exploded perspective view of a raised platform bed in broken lines to show the rear side of the present invention frame in the operable or extended position.

As may be seen in FIG. 3, in the collapsed position, each of the horizontal support links (84 and 86), and each separate link segment (84*a*, 84*b*, 86*a* and 86*b*) is parallel to the end frame assembly horizontal support members (58, 59, 60, 66, 67 and 68). FIG. 4 shows the frame (10) in a transitional position not fully extended. FIGS. 2 and 5 show the frame (10) in the fully operable or extended position wherein each of the horizontal support links (84 and 86) and each separate link segment (84*a*, 84*b*, 86*a* and 86*b*) is perpendicular to the end frame assembly horizontal support members (58, 59, 60, 66, 67 and 68).

FIG. 5 is an exploded perspective view showing the raised platform (14) in broken lines for clarity. The bed posts have openings in the bottom to receive the adaptor caps (53, 55, 63, and 65) of the frame assembly (10). Because the platform (14) has a rigid, rectangular structure, it holds the three-sided frame (10) in the operable position during use of the mounting frame. FIG. 5 further illustrates that the space beneath the overhead platform (or bed) becomes available for usage by the room occupant by providing access to the volume of space through the opening (D) formed by the three-sided frame (10).

Figure 6:
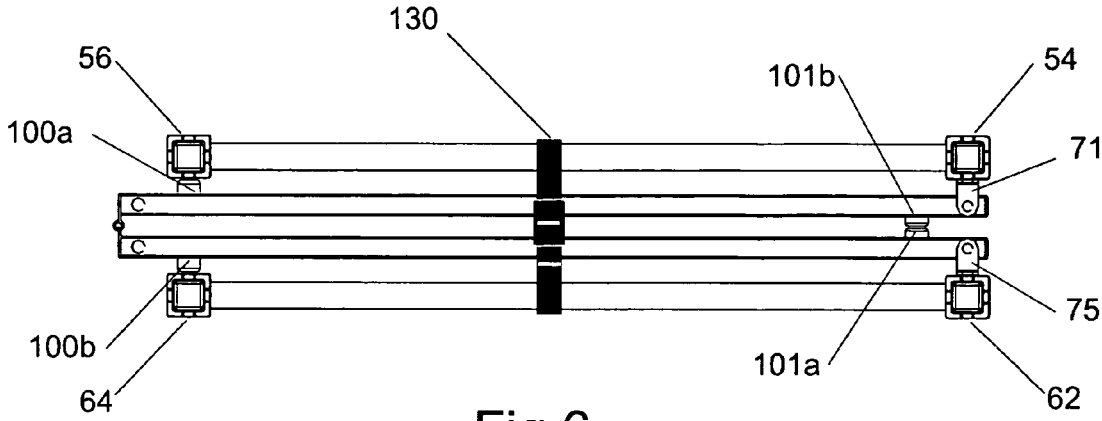
FIG. 6 shows a top plan view of the present invention frame in the folded position showing the resilient bumpers on the stabilizer links.

In the collapsed or folded position as shown in FIGS. 3 and 6, the frame (10) takes up very little space (for storage) and is easy to transport. A strap (130) is attached to one of the links (84 or 86) to be wrapped around the folded frame to keep it in the collapsed position (FIG. 4). FIG. 6 shows how the resilient bumpers (100*a*–100*d*, and 101*a*–101*d*) maintain the proper special relationship between the elements of the frame without overextending the hinges (90 and 92) or allowing the folded parts to contact directly.

Figure 7:
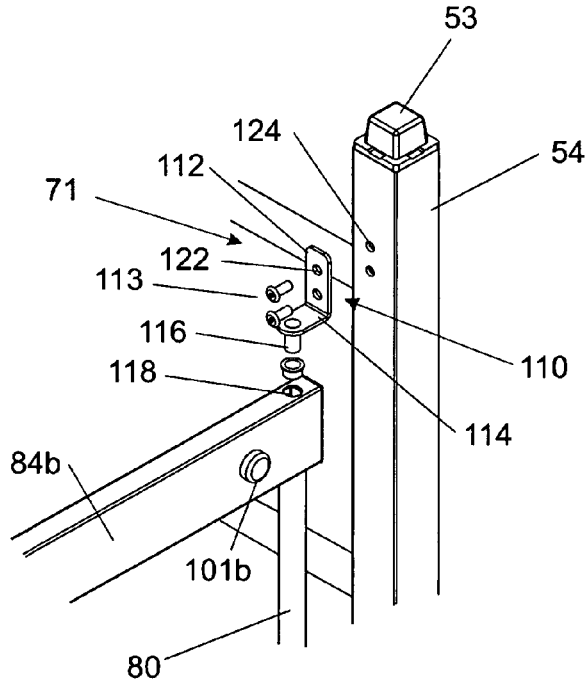
FIG. 7 illustrates a partial perspective view of the pivotable connection between the end frame assembly and the horizontal frame stabilizer of the present invention.

Each of the pivotal connections (71, 73, 75 and 77) is identical. FIG. 7 illustrates an exploded perspective view of connection (71). A generally L-shaped bracket (110) is affixed by any standard fastener (113) to openings (124) in vertical post (54) along an upwardly extending leg member (112). A perpendicularly extending foot (114) supports and positions a downwardly depending lug (116). The lug (116 is pivotally receivable into a bushing (118) which securely fits into an aperture (120) in the link segment (84*b*).

The invention claimed is:

1. A collapsible three-sided mounting frame for supporting a rigid, rectangularly shaped raised platform and providing an access opening to the volume of space beneath said platform comprising:

a first end frame assembly for attachment to an underside of said raised platform, said first end frame assembly having first and second spaced apart vertical posts and a plurality of first horizontal support members attached to and extending between said first and second vertical posts to retain said first and second vertical posts in parallel and coplanar relationship;

a second end frame assembly for attachment to said underside of said platform, said second end frame assembly being a second side of said three-sided mounting frame, said second end frame member having third and fourth spaced apart vertical post and a plurality of second horizontal support members attached to and extending between said third and fourth vertical posts to retain said third and fourth vertical posts in parallel and coplanar relationship;

a single folding horizontal frame stabilizer pivotally connected at a first end to said first vertical post and pivotally connected at a second end to said third vertical post, said horizontal frame stabilizer being a third side of said three-sided mounting frame, said single stabilizer comprising:

first and second spaced apart vertical leg members;

a plurality of horizontal support links of equal length, said links attached to and extending between said first and second vertical leg members to retain said first and second leg members in parallel relationship, each of said links having a hinge at a midpoint along said length of each of said links, said hinge movable from a first collapsed position wherein each of said plurality of horizontal support links is parallel to said plurality of first horizontal support member and said plurality of second horizontal support members to a second extended position wherein each of said plurality of horizontal support links is perpendicular to said plurality of first horizontal support members and said plurality of second horizontal support members, said first end frame, said second end frame, and said single folding horizontal stabilizer cooperating to provide said access opening.

2. The mounting frame of claim 1 further comprising an adaptor cap atop each of said first, second, third and fourth vertical posts for connection to said underside of said raised platform.

3. The mounting frame of claim 2 further comprising a first set of resilient bumpers attached on a first face to an inside surface of one of said horizontal support links, a second set of resilient bumpers attached on a first face to an inside surface of another of said horizontal support links, said first set of bumpers abutting along a second face with said second vertical post and said second set of bumpers abutting along a second face with said fourth vertical post when said hinges are in said collapsed position.

4. The mounting frame of claim 1 wherein each of said pivotal connections at said first and third vertical posts further comprises:

an L-shaped bracket member affixed to said posts along a upwardly extending leg of said bracket;

a generally horizontally extending foot on said bracket, said foot having a downwardly depending leg;

an aperture in each of said links having a bushing therein, said leg pivotally extending within said bushing.

5. The frame of claim 2 wherein said raised platform comprises:

a bed frame having first and second spaced apart end frames each having a longitudinal axis;

first and second spaced apart horizontal support members each having a longitudinal axis, said horizontal support members connect at first ends to said first end frame and at said second ends to said second end, each of said horizontal support members longitudinal axis extending parallel to the other and perpendicular to each of said end frame longitudinal axis;

said adaptor caps atop said first and second vertical posts receivable within openings in a bottom of said first end frame said adaptor caps atop said third and fourth vertical posts receivable within openings in a bottom of said second end frame.

* * * * *